US006435697B1

(12) United States Patent
Simmons et al.

(10) Patent No.: US 6,435,697 B1
(45) Date of Patent: Aug. 20, 2002

(54) EXTERIOR LIGHTING SYSTEM

(76) Inventors: Joseph E. Simmons, 45 Malba Dr., Shirley, NY (US) 11967; Stanley E. Simmons, 30 Ontario St., Port Jefferson Station, NY (US) 11776

( * ) Notice: Subject to any disclaimer, the term of this patent is extended or adjusted under 35 U.S.C. 154(b) by 0 days.

(21) Appl. No.: 09/775,450

(22) Filed: Feb. 2, 2001

(51) Int. Cl.[7] ..... F21S 4/00
(52) U.S. Cl. ..... 362/219; 362/225; 439/207
(58) Field of Search ..... 362/219, 221, 362/222, 225, 217, 238, 227, 145, 239, 250, 226, 223, 224; 439/207–213, 209; 52/28

(56) References Cited

U.S. PATENT DOCUMENTS 4,335,422 A 6/1982 Van Ess
4,905,131 A 2/1990 Gary
4,999,755 A * 3/1991 Lin ..... 362/250
5,023,762 A 6/1991 Tieszen
5,226,724 A 7/1993 Kanarek
5,249,108 A 9/1993 Gary
D348,623 S 7/1994 Shepard
5,404,279 A * 4/1995 Wood ..... 362/145

* cited by examiner

*Primary Examiner*—Sandra O'Shea
*Assistant Examiner*—Bao Truong

(57) ABSTRACT

An exterior lighting system for providing permanent installation of external lighting for structures. The exterior lighting system includes a base portion adapted for affixing to a structure, a front portion coupled to the base portion and a lamp coupled to the base portion.

18 Claims, 3 Drawing Sheets

10
75
40
75
2

75
4
52
48
75
28
60
30
50
54
4
40
75

EXTERIOR LIGHTING SYSTEM

BACKGROUND OF THE INVENTION

1. Field of the Invention

The present invention relates to modular lighting assemblies and more particularly pertains to a new exterior lighting system for providing permanent installation of external lighting for structures.

2. Description of the Prior Art

The use of modular lighting assemblies is known in the prior art. More specifically, modular lighting assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,226,724; U.S. Pat. No. 5,249,108; U.S. Pat. No. 5,023,762; U.S. Pat. No. 4,905,131; U.S. Pat. No. Des. 348,326; and U.S. Pat. No. 4,335,422.

While these devices fulfill their respective, particular objectives and requirements, the aforementioned patents do not disclose a new exterior lighting system. The inventive device includes a base portion adapted for affixing to a structure, a front portion coupled to the base portion and a lamp coupled to the base portion.

In these respects, the exterior lighting system according to the present invention substantially departs from the conventional concepts and designs of the prior art, and in so doing provides an apparatus primarily developed for the purpose of providing permanent installation of external lighting for structures.

SUMMARY OF THE INVENTION

In view of the foregoing disadvantages inherent in the known types of modular lighting assemblies now present in the prior art, the present invention provides a new exterior lighting system construction wherein the same can be utilized for providing permanent installation of external lighting for structures.

The general purpose of the present invention, which will be described subsequently in greater detail, is to provide a new exterior lighting system apparatus and method which has many of the advantages of the modular lighting assemblies mentioned heretofore and many novel features that result in a new exterior lighting system which is not anticipated, rendered obvious, suggested, or even implied by any of the prior art modular lighting assemblies, either alone or in any combination thereof.

To attain this, the present invention generally comprises a base portion adapted for affixing to a structure, a front portion coupled to the base portion and a lamp coupled to the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exterior lighting system apparatus and method which has many of the advantages of the modular lighting assemblies mentioned heretofore and many novel features that result in a new exterior lighting system which is not anticipated, rendered obvious, suggested, or even implied by any of the prior art modular lighting assemblies, either alone or in any combination thereof.

It is another object of the present invention to provide a new exterior lighting system which may be easily and efficiently manufactured and marketed.

It is a further object of the present invention to provide a new exterior lighting system which is of a durable and reliable construction.

An even further object of the present invention is to provide a new exterior lighting system which is susceptible of a low cost of manufacture with regard to both materials and labor, and which accordingly is then susceptible of low prices of sale to the consuming public, thereby making such exterior lighting system economically available to the buying public.

Still yet another object of the present invention is to provide a new exterior lighting system which provides in the apparatuses and methods of the prior art some of the advantages thereof, while simultaneously overcoming some of the disadvantages normally associated therewith.

Still another object of the present invention is to provide a new exterior lighting system for providing permanent installation of external lighting for structures.

Yet another object of the present invention is to provide a new exterior lighting system which includes a base portion adapted for affixing to a structure, a front portion coupled to the base portion and a lamp coupled to the base portion.

Still yet another object of the present invention is to provide a new exterior lighting system that can be installed as a permanent three-dimensional trim feature for structures.

Even still another object of the present invention is to provide a new exterior lighting system that is modular for easy customization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
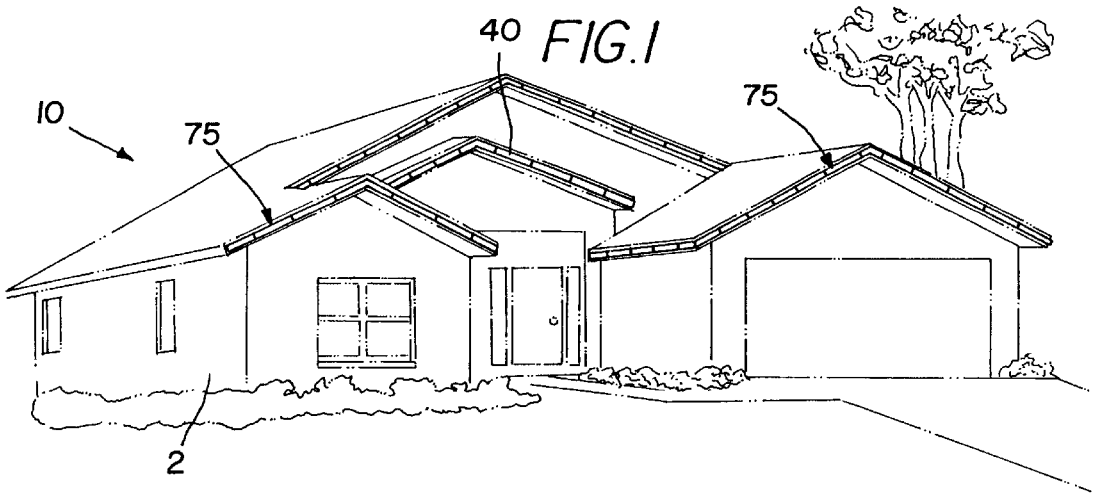
FIG. 1 is a schematic perspective view of a new exterior lighting system according to the present invention.
Figure 2:
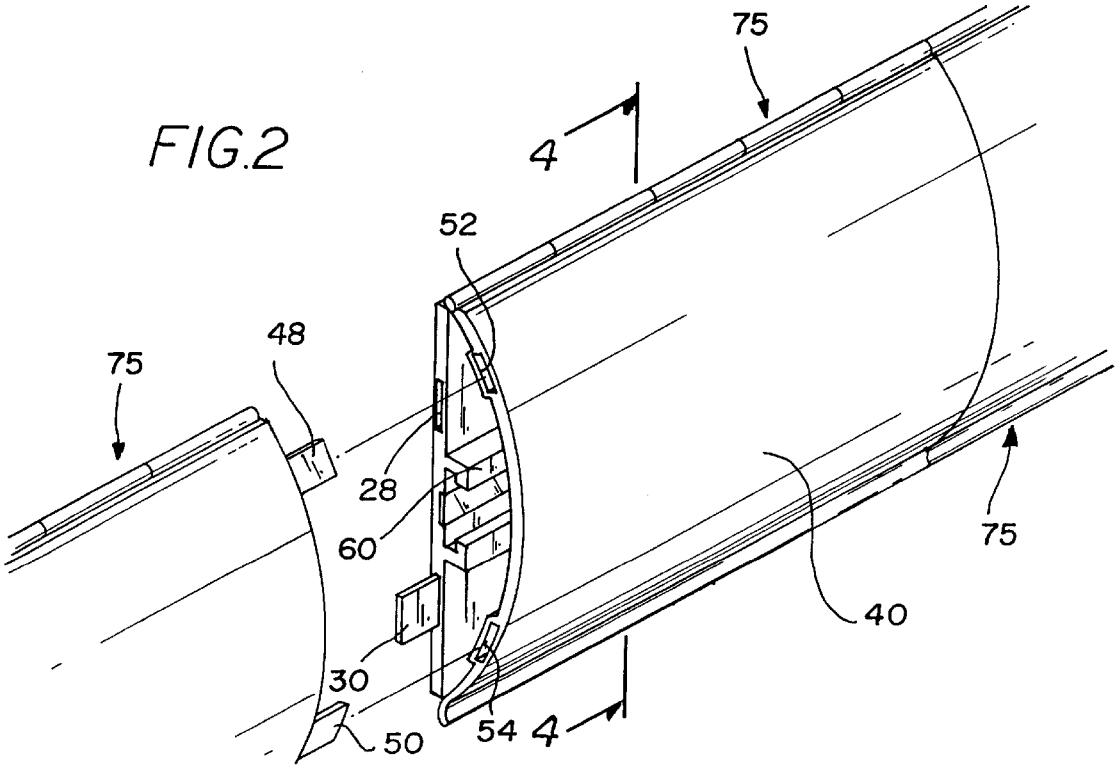
FIG. 2 is a schematic perspective view of the present invention.
Figure 3:
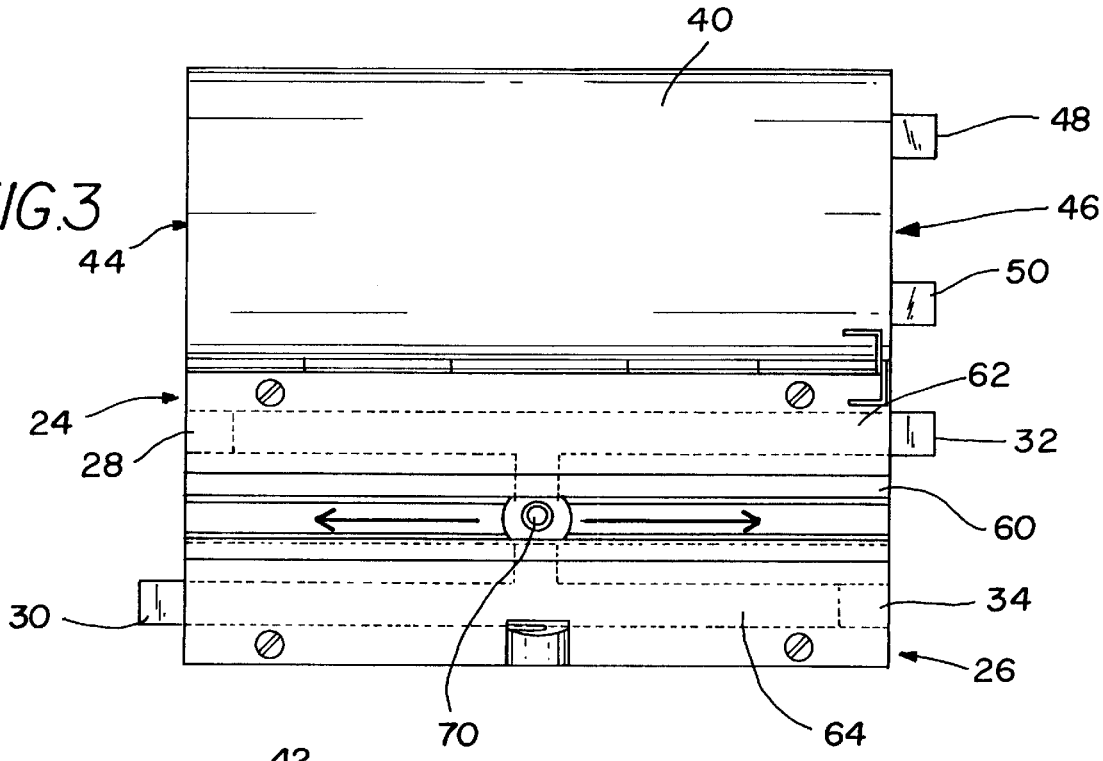
FIG. 3 is a schematic front view of the present invention.
Figure 4:
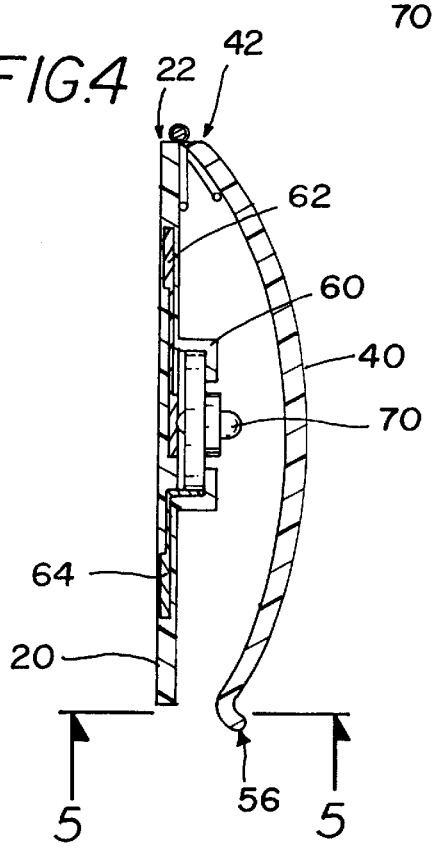
FIG. 4 is a schematic side view of the present invention.
Figure 5:
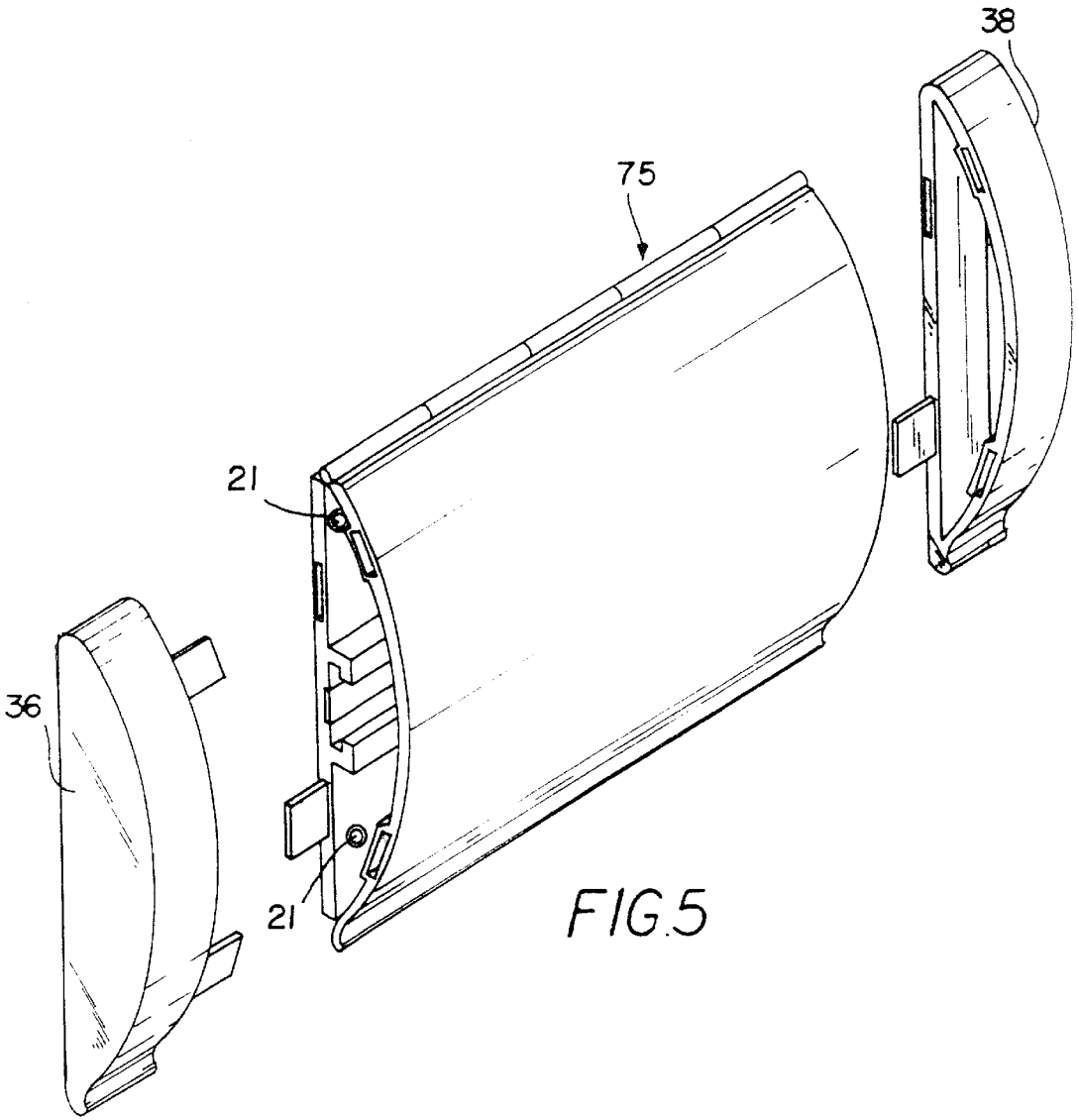
FIG. 5 is a schematic perspective view of the present invention.

With reference now to the drawings, and in particular to FIGS. 1 through 5 thereof, a new exterior lighting system embodying the principles and concepts of the present invention and generally designated by the reference numeral 10 will be described.

As best illustrated in FIGS. 1 through 5, the exterior lighting system 10 generally comprises a plurality of modular sections 75 each having a base portion 20, a front portion 40, and a lamp 70.

The base portion 20 is designed for affixing to a surface of a structure 2. The front portion 40 is coupled to the base portion 20. The lamp 70 is coupled to the base portion 20. Each of the modular sections 75 is selectively couplable to an adjacently positioned one of the modular sections 75.

The front portion 40 of each the modular sections 75 includes a substantially arcuate cross section when viewed transverse to a longitudinal axis of the front portion 40.

The front portion 40 of each modular section 75 is substantially translucent for permitting light from the lamp 70 to pass through the front portion 40. Thus the modular section 75 is designed for illuminating an area adjacent to the front portion 40.

Each of the front portions 40 includes a top edge 42. Each of the base portions 20 includes a top edge 22. The top edge 42 of the front portion 40 is hingeably coupled to the top edge 22 of the base portion 20 such that the front portion 40 is selectively pivotable with respect to the base portion 20.

Each of the base portions 20 includes a first end 24 and a second end 26. The first end 24 includes an upper receptacle 28 and a lower plug 30. The second end 26 of each the base portions 20 includes an upper plug 32 and a lower receptacle 34.

The upper plug 32 and the lower receptacle 34 of the second end 26 is positioned such that the upper plug 32 and the lower receptacle 34 of the second end 26 of the base portion 20 are alignable with and mateable to the upper receptacle 28 and the lower plug 20 of the first end 24 of a second of the base portions 20.

The front portion 40 includes a first end 44 and a second end 46. The first end 44 includes an upper tab 48 and a lower tab 50. The second end 46 of the front portion 40 includes a upper recess 52 and a lower recess 54. The upper recess 52 and the lower recess 54 of the second end 46 are positioned such that the upper recess 52 and the lower recess 54 of the second end 46 are alignable with and mateable to the upper tab 48 and the lower tab 50 of a second of the front portions 40.

The base portion 20 includes a track member 60 for receiving the lamp 70 such that the lamp 70 is held in a static position between the base portion 20 and the front portion 40.

The track member 60 includes a first conductive portion 62 and a second conductive portion 64. The first conductive portion 62 and the second conductive portion 64 are for providing electrical current to the lamp 70.

A first cap member 36 is selectively engageable to a first end of an outermost modular section 75 such that the first cap member 36 closes an opening created by a first perimeter edge of the base portion 20 and the front portion 40.

A second cap member 38 is selectively engageable to a second end of an outermost modular section 75 such that the second cap member 38 closes an opening created by a second perimeter edge of the base portion 20 and the front portion 40.

The base portion 20 includes a plurality of apertures 21 for receiving a connection member therethrough for facilitating coupling of the base portion 20 to a surface of a structure 2.

In an embodiment, the receptacles 28,34 and the plugs 30,32 are conductive. Thus the track member 60 of a first base portion 20 is in electrical communication with the track member 60 of a second base portion 20 when the second base portion 20 is coupled to the first base portion 20.

The front portion 40 includes a lip member 56 extending from a longitudinal edge of the front portion 40 such that the lip member 56 is in a substantially parallel relationship with a longitudinal axis of the front portion 40.

In use, the desired number of modular sections are connected end to end and affixed to a surface of a structure. The lamps are positioned along the track members as desired by the user. The front portions are hinged to the closed position. The first and second cap members are attached to the two outer most modular assemblies. Thus the opening created by the perimeter walls of the base portion and the front portion for the two outer most modular assemblies is closed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exterior lighting system comprising:

a plurality of modular sections, each of said modular sections having a base portion, a front portion, and a lamp;

said base portion being adapted for affixing to a surface of a structure;

said front portion being coupled to said base portion;

said lamp being coupled to said base portion;

each of said modular sections being selectively couplable to an adjacently positioned one of said modular sections; and said base portion having a track member for receiving said lamp, said lamp being slidable in said track member for positioning said lamp at a desired position along said track, said track receiving said lamp such that said lamp is held in said desired position between said base portion and said front portion;

each said base portion having a first end and a second end; said first end having an upper receptacle, said first end having a lower plug;

said second end of each said base portion having an upper plug, said second end of said base portion having a lower receptacle;

said upper plug and said lower receptacle of said second end being positioned such that said upper plug and said lower receptacle of said second end of said base portion are alignable with and mateable to said upper receptacle and said lower plug of said first end of a second of said base portions.

2. The exterior lighting system of claim 1, further comprising:

said front portion of each said modular section having a substantially arcuate cross section when viewed transverse to a longitudinal axis of said front portion.

3. The exterior lighting system of claim 1, further comprising:

said front portion of each modular section being substantially translucent for permitting light from said lamp to pass through said front portion whereby said modular section is adapted for illuminating an area adjacent to said front portion.

4. The exterior lighting system of claim 1, further comprising:

each said front portion having a top edge, each said base portion having a top edge, said top edge of said front portion being hingeably coupled to said top edge of said base portion such that said front portion is selectively pivotable with respect to said base portion.

5. The exterior lighting system of claim 1, further comprising:

said front portion having a first end and a second end, said first end having an upper tab and a lower tab;

said second end of said front portion having a upper recess and a lower recess, said upper recess and said lower recess of said second end being positioned such that said upper recess and said lower recess of said second end are alignable with and mateable to said upper tab and said lower tab of a second of said front portions.

6. The exterior lighting system of claim 1, further comprising:

said track member having a first conductive portion and a second conductive portion; said first conductive portion and said second conductive portion being for providing electrical current to said lamp.

7. The exterior lighting system of claim 1, further comprising:

said base portion having a plurality of apertures such that said base portion is adapted for coupling to the structure using a plurality of connection members inserted through said apertures.

8. The exterior lighting system of claim 6, further comprising:

said receptacles and said plugs being conductive whereby said track of a first base portion is in electrical communication with said track of a second base portion when said second base portion is coupled to said first base portion.

9. The exterior lighting system of claim 1, further comprising:

said front portion having a lip member extending from a longitudinal edge of said front portion such that said lip member is in a substantially parallel relationship with a longitudinal axis of said front portion.

10. An exterior lighting systems comprising:

a plurality of modular sections, each of said modular sections having a base portion, a front portion, and a lamp;

said base portion being adapted for affixing to a surface of a structure;

said front portion being coupled to said base portion;

said lamp being coupled to said base portion; and each of said modular sections being selectively couplable to an adjacently positioned one of said modular sections;

said front portion of each said modular section having a substantially arcuate cross section when viewed transverse to a longitudinal axis of said front portion;

said front portion of each modular section being substantially translucent for permitting light from said lamp to pass through said front portion whereby said modular section is adapted for illuminating an area adjacent to said front portion;

each said front portion having a top edge, each said base portion having a top edge, said top edge of said front portion being hingeably coupled to said top edge of said base portion such that said front portion is selectively pivotable with respect to said base portion;

each said base portion having a first end and a second end; said first end having an upper receptacle, said first end having a lower plug;

said second end of each said base portion having an upper plug, said second end of said base portion having a lower receptacle;

said upper plug and said lower receptacle of said second end being positioned such that said upper plug and said lower receptacle of said second end of said base portion are alignable with and mateable to said upper receptacle and said lower plug of said first end of a second of said base portions;

said front portion having a first end and a second end, said first end having an upper tab and a lower tab;

said second end of said front portion having a upper recess and a lower recess, said upper recess and said lower recess of said second end being positioned such that said upper recess and said lower recess of said second end are alienable with and mateable to said upper tab and said lower tab of a second of said front portions;

said base portion having a track member for receiving said lamp, said lamp being slidable in said track member for positioning said lamp at a desired position along said track, said track receiving said lamp such that said lamp is held in said desired position between said base portion and said front portion;

said track member having a first conductive portion and a second conductive portion, said first conductive portion and said second conductive portion being for providing electrical current to said lamp;

said base portion having a plurality of apertures such that said base portion is adapted for coupling to the structure using a plurality of connection members inserted through said apertures;

wherein said receptacles and said plugs being conductive whereby said track of a first base portion is in electrical communication with said track of a second base portion when said second base portion is coupled to said first base portion; and said front portion having a lip member extending from a longitudinal edge of said front portion such that said lip member is in a substantially parallel relationship with a longitudinal axis of said front portion.

11. An exterior lighting system comprising:

a plurality of modular sections, each of said modular sections having a base portion, a front portion, and a lamp;

said base portion being adapted for affixing to a surface of a structure;

said front portion being coupled to said base portion;

said lamp being coupled to said base portion;

each of said modular sections being selectively couplable to an adjacently positioned one of said modular sections; and said base portion having a track member for receiving said lamp, said lamp being slidable in said track member for positioning said lamp at a desired position along said track, said track receiving said lamp such that said lamp is held in said desired position between said base portion and said front portion;

said front portion having a first end and a second end, said first end having an upper tab and a lower tab;

said second end of said front portion having a upper recess and a lower recess, said upper recess and said lower recess of said second end being positioned such that said upper recess and said lower recess of said second end are alignable with and mateable to said upper tab and said lower tab of a second of said front portions.

12. The exterior lighting system of claim 11, wherein said front portion of each said modular section has a substantially arcuate cross section when viewed transverse to a longitudinal axis of said front portion.

13. The exterior lighting system of claim 11, wherein said front portion of each modular section is substantially translucent for permitting light from said lamp to pass through said front portion whereby said modular section is adapted for illuminating an area adjacent to said front portion.

14. The exterior lighting system of claim 11, wherein each said front portion has a top edge, each said base portion having a top edge, said top edge of said front portion being hingeably coupled to said top edge of said base portion such that said front portion is selectively pivotable with respect to said base portion.

15. The exterior lighting system of claim 11, wherein said track member has a first conductive portion and a second conductive portion: said first conductive portion and said second conductive portion being for providing electrical current to said lamp.

16. The exterior lighting system of claim 11, wherein said base portion has a plurality of apertures such that said base portion is adapted for coupling to the structure using a plurality of connection members inserted through said apertures.

17. The exterior lighting system of claim 15, wherein said receptacles and said plugs is conductive whereby said track of a first base portion is in electrical communication with said track of a second base portion when said second base portion is coupled to said first base portion.

18. The exterior lighting system of claim 11, wherein said front portion has a lip member extending from a longitudinal edge of said front portion such that said lip member is in a substantially parallel relationship with a longitudinal axis of said front portion.

* * * * *